US005267664A

United States Patent [19]

Younikian

[11] Patent Number: 5,267,664

[45] Date of Patent: Dec. 7, 1993

[54] FOLDING BASKET

[76] Inventor: Petgha Younikian, 553 South St., Apt. 108, Glendale, Calif. 91202

[21] Appl. No.: 973,175

[22] Filed: Nov. 9, 1992

[51] Int. Cl.[5] ..... B60R 9/10

[52] U.S. Cl. ..... 220/6; 220/489

[58] Field of Search ..... 220/6, 485, 489, 495

[56] References Cited

U.S. PATENT DOCUMENTS

| | | | |
|---|---|---|---|
| 820,716 | 5/1906 | Haynes et al. | 220/489 |
| 957,069 | 5/1910 | Bauve | 220/495 |
| 1,719,583 | 7/1929 | Blaukowitcsh | 220/489 |
| 2,121,403 | 6/1938 | Lapinskas | 220/489 |
| 2,812,098 | 11/1957 | Escaut | 220/489 |
| 3,229,843 | 1/1966 | Fouineteau et al. | 220/489 |
| 3,923,187 | 12/1975 | Johansson et al. | 220/19 |
| 4,478,260 | 10/1984 | Eichler | 140/92.1 |
| 4,826,032 | 5/1989 | Huyghe | 220/19 |
| 4,915,248 | 4/1990 | Chap | 220/19 |
| 4,936,480 | 6/1990 | Apostolo | 220/19 |

*Primary Examiner*—Joseph Man-Fu Moy
*Attorney, Agent, or Firm*—Andrew Jordan

[57] ABSTRACT

A folding basket having pivotable sides allowing the basket to attain and sustain a number of configurations. A platform providing support for items held within the basket has upper and lower pivotable sides connected at its perimeter. Likewise, a rim allowing articles to pass through it into the basket's interior has upper and lower pivotable sides connected at its perimeter. The upper platform side is pivotably connected to the lower rim side. The basket so constructed is completely collapsible, yet when unfolded, can provide a basket with a large payload.

1 Claim, 2 Drawing Sheets

FIG. 2
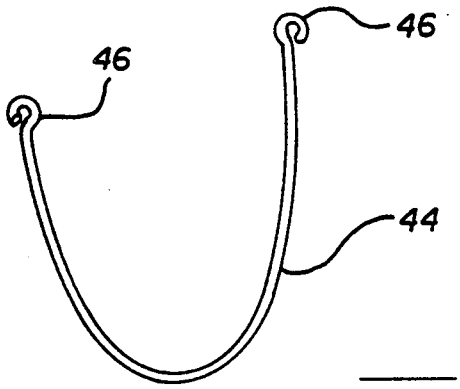
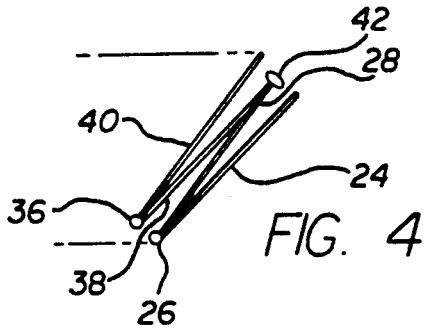
FIG. 4
FIG. 6
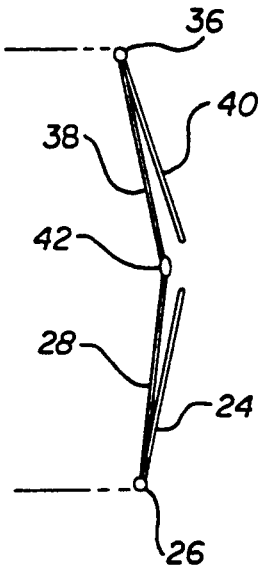
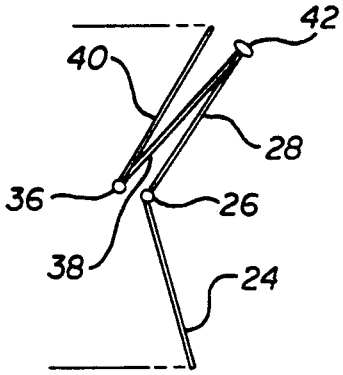
FIG. 5
FIG. 3
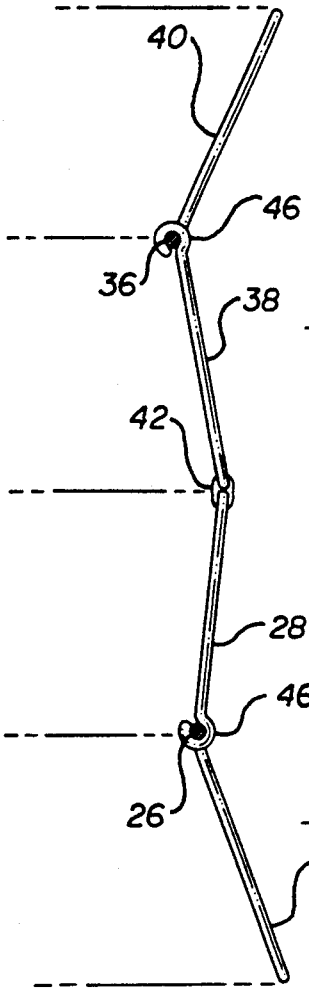
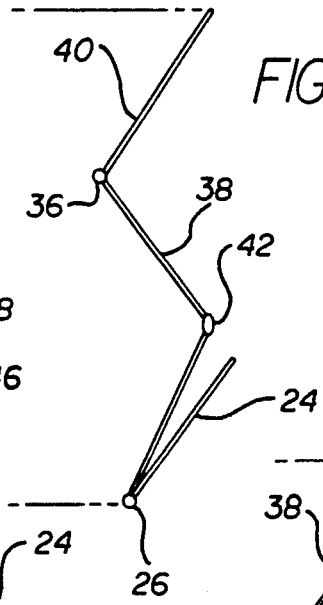
FIG. 7
FIG. 8
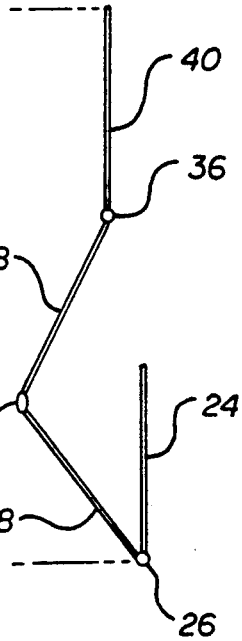
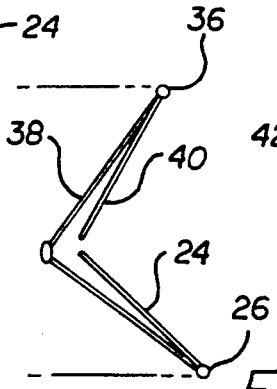
FIG. 9

FOLDING BASKET

BACKGROUND OF THE INVENTION

1. Field of the Invention

This invention relates to containers such as baskets, and more particularly to flexibly articulating wire baskets able to attain a number of shapes.

2. Description of the Related Art including information disclosed under 37 C.F.R. §§ 1.97–1.99.

Baskets are familiar objects in everyday life. Shopping baskets in grocery stores and farmers' bushel baskets are two examples of baskets in common use today.

A basket generally has an exterior shell defining a cavity in which items may be carried. A handle may be connected to the exterior shell so that the basket may be conveniently lifted and carried. The exterior shell is commonly made of dried vegetable matter such as willow shoots or cane palm. However, more permanent materials may be used with success.

The rigid basket shell exterior provides sturdy support for those items carried inside the basket's cavity. However, such rigidity prevents baskets from attaining a variety of shapes or sizes. Further, such rigidity prevents the basket from folding compactly for easy storage requiring a minimum of space.

SUMMARY OF THE INVENTION

The present invention is a folding basket, preferably made of interlaced wire arcs or arches, with sides that fold so that the basket may attain a number of useful configurations.

A platform is provided that forms the foundation for the folding basket and around which two of the basket sides hinge. A rim is provided above the platform that adds support to the folding basket, increases the basket's cavity, and around which two other basket sides hinge. The basket side above the platform is connected to the basket side below the rim so that the two connected sides may hingeably articulate with respect to one another. Because all the basket sides can articulate with respect to their points of connection, the basket can fold in a variety of useful ways, quickly providing the configuration best suited for the task at hand.

OBJECTS OF THE INVENTION

It is an object of the present invention to provide a folding basket.

It is an object of this invention to provide a folding basket that retains its shape once set into place.

It is an object of this invention to provide a folding basket which is both completely collapsible, yet has a significant payload capacity.

It is an object of this invention to provide a basket that is easy to ship and store by having foldable sides.

It is an object of this invention to provide a basket that can attain and hold a variety of useful shapes and configurations.

These and other objects and advantages of the present invention will be apparent from a review of the following specification and accompanying drawings.

BRIEF DESCRIPTION OF THE DRAWINGS

FIG. 2 is a single arc or arch used to construct the sides of the folding basket.

FIGS. 3–9 are a series of possible basket-side configurations, each taken as if viewed along line 3—3 of FIG. 1.

DESCRIPTION OF THE PREFERRED EMBODIMENT(S)

Figure 1:
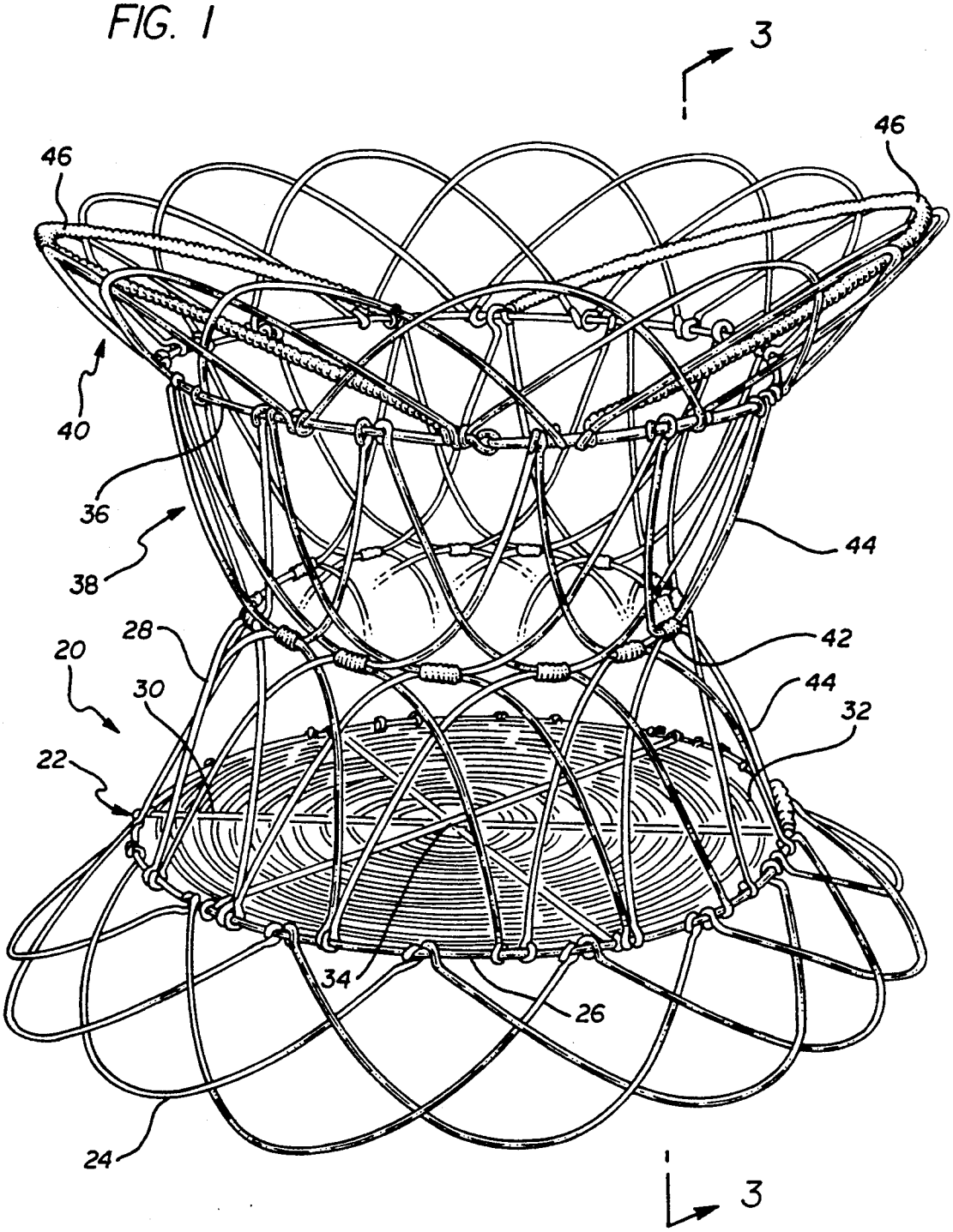
FIG. 1 is a perspective view of the folding basket of the present invention.

Referring to FIG. 1, the folding basket 20 of the present invention is shown in perspective.

The platform 22 provides a foundation for the basket and supports any articles that may be carried by the basket 20. The platform 22 is pivotably connected to a first and lowest basket side 24 at the outside edge 26 of the platform 22. A second, upper platform basket side 28 is connected to the platform 22 in the same manner as the lower platform basket side 24. Opposite edges of the platform 22 are connected by a series of spokes 30 that traverse the face of the platform 22. The arms of the spokes 30 are interconnected by a spiral 32 to reduce the size of gaps present between the spokes 30 so that articles may be supported by the platform 22.

The spiral 32 centers upon the intersection 34 of the spokes 30. As it circles about the face of the platform 22, the spiral 32 moves outwardly towards the outer edge 26 of the platform 22. In this way, the face of the platform 22 is traversed by the spiral 32 so that the space present between the spokes 30 is traversed and those objects placed inside the basket may not fall between the spokes 30. The spokes 30 provide support for the spiral 32 so that it will not bend and/or flex and so that a firm support is provided for objects carried by the basket.

Above the platform 22 and its lower 24 and upper 28 sides, a rim 36 is provided to which are attached lower 38 and upper 40 rim basket sides. The lower 38 and upper 40 rim basket sides are connected to the rim 36 in a manner similar to the connections made between the platform 22 and its basket sides 24, 28.

The upper platform basket side 28 is connected to the lower rim basket side 38 by bindings 42 that enshroud two opposite and individual arcs 44. The binding 42 tightly holds the two arcs 44 together, yet allows the two arcs 44 to turn or articulate with respect to one another. The tightness of the binding 42 serves to provide significant friction between the two arcs 44 and the binding 42. The friction present between the arcs 44 and the binding 42 is not so great as to obstruct the articulation of the two arcs 44 with respect to one another, yet the friction is sufficient to hold the two arcs 44 in place when items are placed in the basket 20 and press against the sides 28, 38 of the basket cavity. In this way, the basket 20 can better maintain its shape when carrying items, yet can be configured to achieve a number of shapes.

Two coil handles 46 are provided at the top of the basket 20. The handles 46 are larger arcs of material that are attached to opposite sides of the rim 36. In order to provide a more convenient handle 46, the ends of the handle arcs are bent to form an approximately 150° angle with the rest of the handle 46, or in other words, to form an angle approximately 30° from the plane of the handle 46.

Having described the overall structure of the basket 20, description is now made of the articulating portions, namely the basket sides 24, 28, 38, 40. Referring now to FIG. 2, a single wire arc 44 is shown in isolated detail. The arc 44 is somewhat parabolic in shape, but might also be semi-circular or other openly curved shape. At opposite, free ends of the arc 44 are two loops 46. These loops serve to pivotably attach the arc 44 to either the outside edge 26 of the platform 22 or to the rim 36. Each of the loops 46 is turned to face the other in planes generally perpendicular to that of the arc 44 as a whole. In this way, the loops 46 of the arc 44 are better able to engage the basket 20. Relatively speaking, one loop 46 is turned inward, while the other loop 46 is turned outward so that the two loops 46 are turned in generally opposite directions. Turning the loops 46 in opposite directions provides certain advantages over turning the loops in the same direction. However, loops turned in the same direction may also be used in the folding basket of the present invention. The loops 46 are generally large enough to allow the arc 44 to rotate or pivot around the connected rim 36 or the platform outer edge 26.

When the arcs 44 are connected to the basket 20, they are interlaced so that the rotation of any one arc 44 about its pivots also forces the adjacent arcs 44 to turn about theirs. Movement of one arc 44 about its pivots serves to urge that entire basket side to move with that arc 44. Friction is present between the arcs 44 of any single basket side and this friction, along with that present at the loops 46 of the arcs, serves to hold the basket sides in place without prohibiting articulation of the basket sides.

One interlacing scheme for the folding basket of the present invention is described as follows moving left to right and starts with a single arc 44 with its two loops 46 attached to the basket 20 at the outer edge 26 of the platform 22 or at the rim 36. The leftmost loop 46 is contemplated as facing outward from the basket 20 and the rightmost loop 46 is contemplated as facing inward. A second arc 44 is then connected to the basket 20 adjacent to the first arc 44. One loop 46 of the second arc 44 is connected to the basket 20 between the two loops 46 of the first arc 44. The second loop 46 of the second arc 44 is connected to the basket 20 outside of the two loops 46 of the first arc 44. For the purposes of this example, it is assumed that the first arc 44 is inside of, or closer to the basket interior, than the second arc 44.

A third arc 44 is also connected to the basket 20. One loop 46 of the third arc 44 is connected to the basket 20 between the first loop 46 of the second arc 44 and the second loop 46 of the first arc 44 so that the first loop 46 of the third arc 44 is within the interiors of both the first and second loops 46. The second loop 46 of the third arc is connected to the basket 20 outside of the loops 46 of both the first and second arcs 44. The third arc passes inside of the first arc 44, but outside of the second arc 44. This entraps the second arc 44 between the first and third arcs 44 and establishes the same inside/outside relationship between the third and second arcs 44 as for the second and first arcs 44.

This three-arc pattern forms a basic interlace unit that can be repeated about the perimeter of the basket 20. To continue the pattern, the second arc 44 is now considered to be the first arc in the series. What was previously the third arc 44 is now the second arc 44 and is already outside of the new first arc 44. A new arc 44 is added to the sequence in the same manner as the old third arc 44, entrapping the new second arc 44 between the new first and third arcs 44.

When the arcs 44 are established about the perimeter of the basket 20, each arc 44 is coupled to the two preceding and the two subsequent arcs 44. The following description should be interpreted as moving left to right about the basket 20 perimeter. The most preceding arc 44 is outside the arc 44 in question. The least preceding arc 44 is inside the arc 44 in question. The least subsequent arc 44 is outside the arc 44 in question. Finally, the most subsequent arc 44 is inside the arc 44 in question. Other interlace schemes may also be used to construct the folding sides of basket 20, such as reversing the interlace for lower basket sides 24, 38.

For both the rim 36 and the outer edge 26 of the platform 22, the connections to the basket 20 present for an upper basket side (sides 40 and 28) are syncopated with the connections to the basket 20 for the corresponding lower side (sides 38 and 24, respectively).

FIGS. 3–9 show in skeletal cross-section several configurations attainable by the sides of the basket 20. These configurations range from the completely extended (FIG. 3) to the entirely collapsed (FIG. 4). Of note in FIGS. 4 and 5 is the smaller diameter of the rim 36 in comparison with the outer edge 26 of the platform 22. When the basket 20 is configured as shown in FIGS. 4 or 5, the smaller diameter of the rim 36 serves to "lock" the basket cavity sides 28 and 38 into place and to provide a closer fit between those two sides.

Each basket side provides the basket 20 with different advantages. The lowest basket side is the lower platform side 24 which serves to either: lift the platform 22 from its ultimate support as in FIGS. 1, 3 and 5; to provide additional support for the basket 20 as in FIGS. 4, 6, 7, and 9; or to provide an additional cavity as in FIG. 8.

The second lowest basket side is the upper platform side 28. The upper platform side 28 may either complement the third lowest basket side, namely the lower rim side 38, (as in FIGS. 1, 3, 6, 7, 8, and 9) or may supplement the lower rim side 38 (as in FIGS. 4 and 5). When the upper platform side 28 complements the lower rim side 38, the cavity of the basket 20 may be expanded or contracted. The cavity is expanded by the complementing sides 28, 38 in FIGS. 3, 6, and 7. The cavity is contracted by the complementing sides in FIGS. 1, 8, and 9. The upper platform side 28 supplements the lower rim side 38 when is provides additional support for it, as in FIGS. 4 and 5.

The uppermost basket side is the upper rim side 40. The upper rim side 40 can enhance the capacity of the basket 20 when it is in its uppermost position (as in FIGS. 1, 3, 7, and 8) or it can provide additional support for one or more other sides of the basket 20 (as in FIGS. 4, 5, 6, and 9).

One aesthetic feature of the folding basket of the present invention is that the sides of the basket 20 are very similar in appearance. This similarity in appearances presents a pleasant facade when different sides of the basket are adjacent. As the eye will not readily detect the articulating nature of the basket sides, a basket 20 configured as in FIG. 4 will not readily appear to be made of several portions, but instead will present an integrated appearance. The same is similarly true for the configurations presented in FIGS. 5, 6, 7, and 9.

One gauge of wiring that may be used in the present invention is denominated RG45 C/C 3/32×36. Once the basket has been formed, it may be plated as with bronze or copper or polished to provide a more attractive appearance.

While the present invention has been described with regards to particular embodiments, it is recognized that additional variations of the present invention may be devised without departing from the inventive concept.

What I claim is:

1. A folding basket, comprising:

a platform, said platform having an outer edge with a first circumference, said platform providing support for articles placed in the basket;

a first basket side, said first basket side comprising interlaced arcs connected to and articulating about said outer edge;

a second basket side, said second basket side comprising interlaced arcs connected to and articulating about said outer edge;

a third basket side, said third basket side comprising interlaced arcs connected to and articulating with said second basket side;

a rim, said rim having a second circumference smaller than said first circumference of said platform, said third basket side connected to and articulating about said rim; and a fourth basket side, said fourth basket side comprising interlaced arcs connected to and articulating about said rim; wherein said interlacing arcs comprising said first, second, third and fourth basket sides are interlaced in a repeated pattern with first, second, and third arcs, said second arc adjacent to said first arc and said third arc adjacent to said second arc, said first arc attached inside of said second arc with said third arc attached inside said first arc and outside said second arc to entrap said second arc between said first and third arcs; and wherein said smaller circumference of said rim serves to lock the folding basket in position when said second and third basket sides are brought into adjacent positions when the basket is collapsed by bringing said rim adjacent to said platform.

* * * * *